US012624555B2

(12) United States Patent
Egli et al.

(10) Patent No.: US 12,624,555 B2
(45) Date of Patent: May 12, 2026

(54) WINDPROOF AND ANTI-FRAGMENTATION DEVICE FOR A RAISED FLOOR

(71) Applicant: Profilitec S.p.A. Socio Unico, Isola Vicentina (IT)

(72) Inventors: Beat Roderick Egli, Geneva (CH); Andrea Bassetto, Isola Vicentina (IT); Roberto Zaniol, Isola Vicentina (IT)

( * ) Notice: Subject to any disclaimer, the term of this patent is extended or adjusted under 35 U.S.C. 154(b) by 142 days.

(21) Appl. No.: 18/751,649

(22) Filed: Jun. 24, 2024

(65) Prior Publication Data

US 2025/0003237 A1 Jan. 2, 2025

(30) Foreign Application Priority Data

Jun. 28, 2023 (IT) ..... 102023000013359

(51) Int. Cl.
*E04F 15/024* (2006.01)

(52) U.S. Cl.
CPC ..... *E04F 15/02452* (2013.01)

(58) Field of Classification Search
CPC ..... E04F 15/0215; E04F 15/02183; E04F 15/02452; E04F 15/02458; E04F 2201/0505; E04F 2201/0517
USPC ..... 52/220.1
See application file for complete search history.

(56) References Cited

U.S. PATENT DOCUMENTS 3,295,272 A * 1/1967 Kanno ..... E04F 15/02452 52/126.6
3,318,057 A * 5/1967 Norsworthy ..... E04F 15/02452 52/480
3,420,012 A * 1/1969 Custer ..... E04F 15/02405 52/630
4,558,544 A * 12/1985 Albrecht ..... E04F 15/02452 52/126.6
4,578,910 A * 4/1986 Germeroth ..... E04F 15/02452 24/DIG. 54
4,901,490 A * 2/1990 Zinniel ..... E04F 15/02452 248/644
5,072,557 A * 12/1991 Naka ..... E04F 15/02476 52/126.6
5,329,739 A * 7/1994 Madl, Jr. ..... E04B 9/02 52/762
5,333,423 A * 8/1994 Propst ..... E04F 15/02476 248/188

(Continued)

FOREIGN PATENT DOCUMENTS

CN 111305507 6/2020

OTHER PUBLICATIONS

Italian Patent and Trademark Office, Search Report, Jan. 18, 2024—Relevant portions are in English.

*Primary Examiner* — James M Ference
(74) *Attorney, Agent, or Firm* — Themis Law

(57) ABSTRACT

A windproof and anti-fragmentation device of a raised flooring includes a plurality of support plates of cover tiles. The support plates are arranged side by side and each have a groove defined on a perimeter portion. The windproof and anti-fragmentation device also includes an anchoring washer configured to be coupled to the support plates and having an edge emerging transversely with respect to the perimeter of the anchoring washer and conformed so as to partially fit inside the groove of two contiguous plates so as to keep those plates joined together.

7 Claims, 4 Drawing Sheets

(56) References Cited

U.S. PATENT DOCUMENTS

| | | | | |
|---|---|---|---|---|
| 5,848,506 | A * | 12/1998 | Kobayashi | H02G 3/185 52/220.8 |
| 6,564,514 | B1 * | 5/2003 | Rickards | E04H 13/006 52/509 |
| 6,983,570 | B2 * | 1/2006 | Mead | E04F 15/02452 248/188.4 |
| 7,647,732 | B2 * | 1/2010 | Rickards | E04F 13/0814 52/509 |
| 8,302,356 | B2 * | 11/2012 | Knight, III | E04F 15/02452 52/263 |
| 8,881,482 | B2 * | 11/2014 | Cerny | E01C 13/045 52/126.5 |
| 9,499,992 | B2 * | 11/2016 | Busby | E04F 15/02044 |
| 9,683,375 | B2 * | 6/2017 | Kugler | E04F 15/02494 |
| 2004/0139671 | A1 * | 7/2004 | Owen | E04F 15/0247 52/263 |
| 2007/0204539 | A1 * | 9/2007 | Owen | E04F 15/02452 52/263 |
| 2010/0000163 | A1 * | 1/2010 | Tsai | F16F 1/44 52/126.6 |
| 2016/0312477 | A1 * | 10/2016 | Evans | E04B 1/003 |
| 2017/0138066 | A1 * | 5/2017 | Kugler | E04F 15/02452 |
| 2018/0030667 | A1 * | 2/2018 | Penland, Jr. | B32B 3/06 |
| 2020/0299906 | A1 * | 9/2020 | Repasky | E04F 15/0247 |
| 2020/0299974 | A1 * | 9/2020 | Repasky | E04F 15/02464 |
| 2021/0246668 | A1 * | 8/2021 | Bassetto | E04F 15/02464 |
| 2021/0262243 | A1 * | 8/2021 | Bassetto | E04F 15/02464 |
| 2025/0003237 | A1 * | 1/2025 | Egli | E04F 15/02452 |

* cited by examiner

WINDPROOF AND ANTI-FRAGMENTATION DEVICE FOR A RAISED FLOOR

FIELD OF THE INVENTION

The present invention is applicable to the building sector and relates to the construction of raised floorings.

More in detail, the present invention refers to a windproof and anti-fragmentation device for raised floorings.

BACKGROUND OF THE INVENTION

In the building sector, the laying of raised floorings is known. They are particularly convenient as they allow to easily prepare sub-services and manage uneven floorings that would otherwise require particularly expensive interventions such as, for example, the levelling of the surface below the flooring.

Moreover, precisely because of the advantages provided by this cover, raised floorings are increasingly being used to cover and make aesthetically pleasing the outdoor areas of buildings. Even in this case, in fact, the raised floorings allow a faster and more comfortable laying than traditional flooring.

Typically, raised floorings have a load-bearing structure arranged to rest on the ground and on which the flooring is arranged. The latter is typically, but not necessarily, made up of tiles of any material.

The load-bearing structure comprises a plurality of feet on the head of which a beam supporting the edges of adjacent tiles often rests which are, therefore, rested on the load-bearing structure.

This technique, however, has some recognized drawbacks, in particular where the raised flooring is laid outdoors, in particularly windy areas, i.e. subject to particularly intense weather events.

In fact, in case of a particularly strong wind, the tiles may lift up, resulting in the subsequent need to lay the flooring again. However, in some cases, tile lifting caused by the wind can cause damage to the structures and, more generally, to the objects in the surrounding areas as well as be a danger to people. This forces the tiles to be stably fixed to the support structure.

And there is more. In the aforementioned technique, it often happens that, following a collision or in the presence of particularly heavy weights, the tiles crack, sometimes even shattering. This happens because the tiles are supported exclusively by the beam along the perimeter portion adjacent to the edge. Obviously, in this sense, the tile is weaker in its central part.

The above implies the need to replace damaged tiles, resulting in further expenditure of money. Above all, fragmentation can create dangers for things and people.

To overcome the aforementioned drawbacks, techniques are known that provide for using flooring support plates that are directly coupled to the support feet in order to make the flooring a single block and, consequently, heavier and more resistant to phenomena of particular intensity.

Among others, embodiments are known in which washers are used that are arranged on the upper surface of the support plates, at the corners of the plates adjacent to each other. In more detail, the washers are typically coupled to the underlying foot by means of screws. In other words, the tile support plates are fixed to the underlying support structure by screw means. It follows that each plate must be securely fixed to the feet as the force of the wind could lift it up again.

This technique, moreover, is particularly cumbersome, involving a considerable expenditure of time and therefore of money in the installation of the raised flooring. The removal of a single plate to access the underlying spaces or to replace it is also complex.

SUMMARY OF THE INVENTION

The object of the present invention is to overcome at least partially the drawbacks highlighted above by providing a windproof and anti-fragmentation device for a raised flooring that allows to create a raised flooring resistant to wind and, more generally, to atmospheric phenomena of particular intensity.

In particular, an object of the present invention is to provide a windproof and anti-fragmentation device that allows to keep the adjacent tiles joined together, implicitly increasing the resistance of the flooring to the wind lift effect.

Yet another object of the present invention is to provide a windproof and anti-fragmentation device that is simple and quick to install.

Moreover, a further object of the present invention is to provide a windproof and anti-fragmentation device that allows to make the disassembly of the flooring easy.

It follows that another object of the present invention is to provide a windproof and anti-fragmentation device that allows a saving of time in the installation of the flooring and, consequently, a cost saving for the end user.

Moreover, a further object of the present invention is to provide a windproof and anti-fragmentation device that allows to obtain a raised flooring resistant to the heaviest loads.

As a result, another object of the present invention is to provide a windproof and anti-fragmentation device that allows to avoid creating dangerous situations following the breakage of one or more tiles, making it necessary to replace them.

The aforementioned purposes, as well as others that will appear more clearly below, are achieved by a windproof and anti-fragmentation device in accordance with the claims that follow, which are to be considered an integral part of this patent.

In particular, the windproof and anti-fragmentation device of a raised flooring comprises a plurality of support plates of one or more cover tiles, the support plates being arranged side by side.

According to one aspect of the invention, the windproof and anti-fragmentation device comprises at least one anchoring washer couplable to the support plates. More in detail, to this end, the support plates each comprise at least one groove made on at least a perimeter portion thereof. Respectively, according to another aspect of the invention, the anchoring washer has at least one edge emerging transversely with respect to at least one perimeter of the anchoring washer and this edge is conformed so as to fit at least partially inside the grooves of at least two contiguous plates.

Advantageously, the above allows at least pairs of adjacent plates to be joined together.

Still advantageously, this makes the raised flooring more resistant to the wind.

In fact, when the cover tiles are coupled to the support plates, the raised flooring will be a single block and, therefore, much heavier than what happens in the raised floorings of the prior art, in which the tiles are individually coupled to the support structure.

According to another aspect of the invention, the anchoring washer comprises at least one material gap consisting of at least a portion of a circular sector of the washer.

Advantageously, the presence of the material gap allows an insertion in place and a disengagement of at least one of the plates even when the flooring is already installed.

The above, advantageously, makes the raised flooring versatile as well as easily installable and uninstallable even partially if necessary.

According to a further aspect of the invention, the anchoring washer comprises at least one shaped opening so as to allow the insertion of at least one tool for rotating the anchoring washer.

According to a further aspect of the invention, the opening comprises at least one pair of abutment walls for the tool which are spaced apart from each other by a predetermined angle so as to allow the tool to force a rotation of the anchoring washer over a rotation angle corresponding to the predetermined angle and to allow to the tool a counter-rotation corresponding to the predetermined angle so as to be able to extract it from the opening.

Advantageously, this allows the tool to force a rotation of the anchoring washer over a rotation angle corresponding to the predetermined angle and allow to the tool a subsequent counter-rotation corresponding to the predetermined angle so as to be able to extract it from the opening.

From the above, it is evident that the aforementioned purposes and advantages are also achieved by a method for installing a raised flooring comprising the following steps:

- arranging a first support plate in the operating position;
- coupling said at least one anchoring washer to said first support plate;
- partially rotating said at least one washer until said at least one material gap is at said perimeter portion of said at least one second support plate;
- arranging said second support plate in the operating position;
- partially rotating said at least one washer such that said at least one material gap is arranged between said at least one first and at least one second support plates so as to couple said support plates together.

BRIEF DESCRIPTION OF THE DRAWINGS

Additional characteristics and advantages of the invention will become more apparent in the light of the detailed description of a preferred, but not exclusive, embodiment of a windproof and anti-fragmentation device of a raised flooring according to the invention, illustrated by way of non-limiting example with the aid of the unit drawing table in which.

DETAILED DESCRIPTION OF EMBODIMENTS OF THE INVENTION

Figure 1:
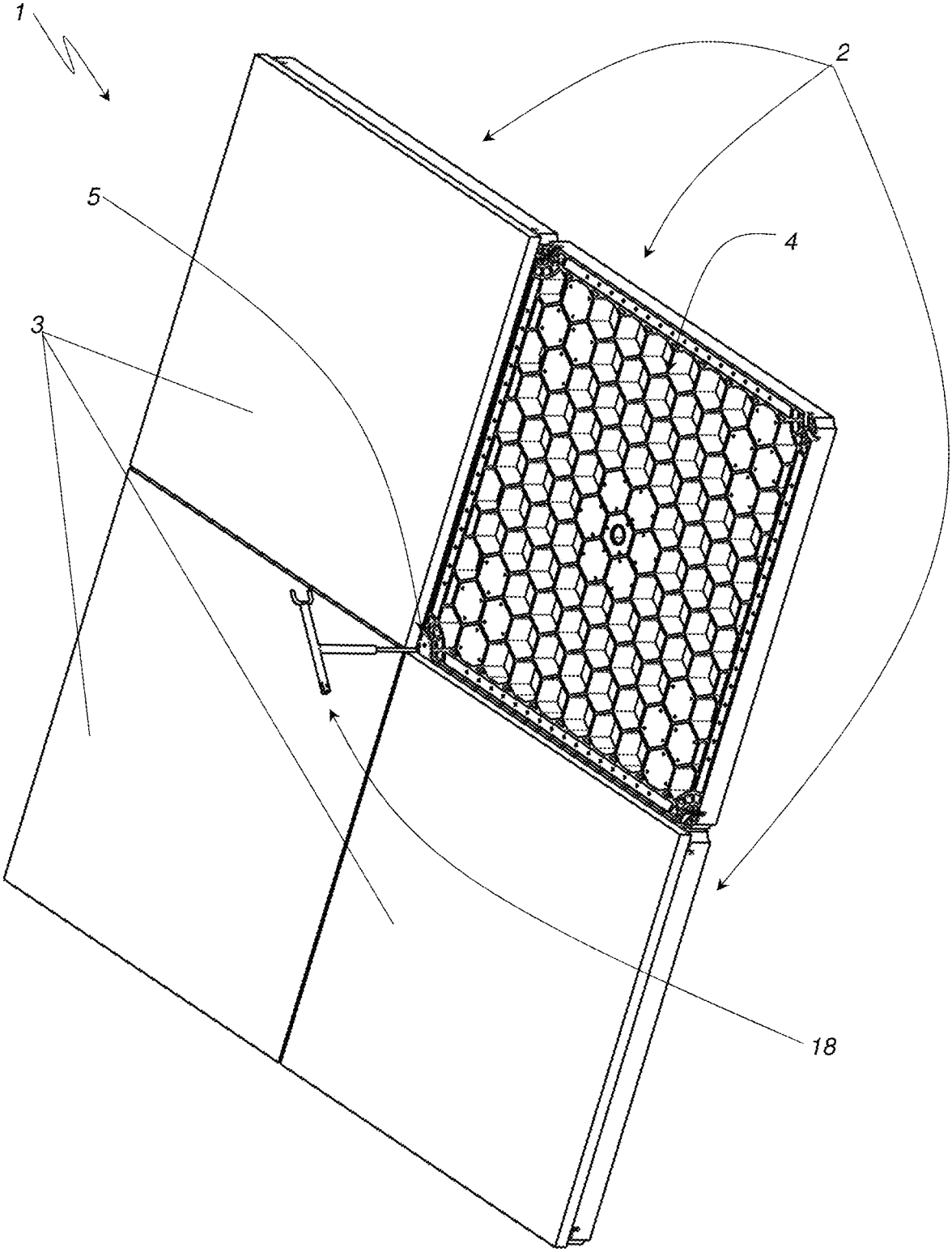
FIG. 1 represents a windproof and anti-fragmentation device of a raised flooring according to the invention.

With reference to the aforementioned figures, a windproof and anti-fragmentation device 1 of a raised flooring is described.

As it happens in known raised floorings, the device 1 according to the invention also comprises a plurality of support plates 2 on which cover tiles 3 are arranged. Obviously, in order to create the flooring, the support plates 2 are arranged side by side.

It can be observed as of now that in the embodiment represented and described herein, both the support plates 2 and the cover tiles 3 have a substantially square shape and the ratio between them is 1:1. Obviously, these aspects shall not be considered limiting for different embodiments of the invention according to which the support plates and/or the cover tiles have different shapes such as, for example, rectangular. The same applies to the fact that a support plate supports a tile: this aspect shall not be considered limiting for embodiment variants according to which a plate supports two or more cover tiles.

Still with reference to the conformation of the support plates 2, according to an aspect of the invention, they comprise a grid 4 which, in more detail, has a honeycomb shaping.

Advantageously, the presence of the grid 4 allows to support the entire surface of the cover tiles 3 while limiting the weight and cost of the support plate 2.

As a result, still advantageously, this makes the raised flooring resistant even to the heaviest loads.

Moreover, advantageously, the grid 4 allows to reduce the risk of the cover tiles 3 cracking or even shattering.

It follows that the above allows to avoid the replacement of 3 tiles that got broken due to the weight and continuous stresses to which raised floorings are normally subjected.

From the above it follows that the presence of the grid 4 also allows cost saving compared to what happens with prior-art flooring in which the cover tiles are supported exclusively by the beam of the support structure.

Moreover, the presence of the grid 4, precisely because it allows to give greater resistance to the raised flooring, makes it more versatile than the raised floorings of the aforementioned prior art.

Obviously, the presence of the grid 4 shall not be considered a limiting feature for the invention. In fact, according to embodiments not depicted herein, the grid is not present or has a different shaping.

Moreover, according to another aspect of the invention, the support plates 2 comprise five gluing areas **4*a* which, in the embodiment described herein, are represented by honeycomb cells with the upper surface covered. It can be observed as of now that the number of gluing areas 4*a*** shall not be considered a limiting feature for different embodiments of the invention according to which, for example, the gluing areas are fewer than or greater than five. The same applies to the conformation of the gluing areas: in fact, according to embodiment variants not represented herein, they comprise slabs stably coupled to the upper surface of the grid on which the tile is laid.

Advantageously, the presence of the gluing areas **4*a* allows the tiles 3 to be coupled to the support plates 2** by means of adhesive.

Moreover, the gluing areas **4*a* allow to increase the coupling surface of the tiles 3 to the support plates 2** compared to what happens in the prior art where the tiles are glued only on the portion near the perimeter of the tile.

According to another aspect of the invention, the windproof and anti-fragmentation device 1 comprises an anchoring washer 5 couplable to the support plates 2.

Figure 4:
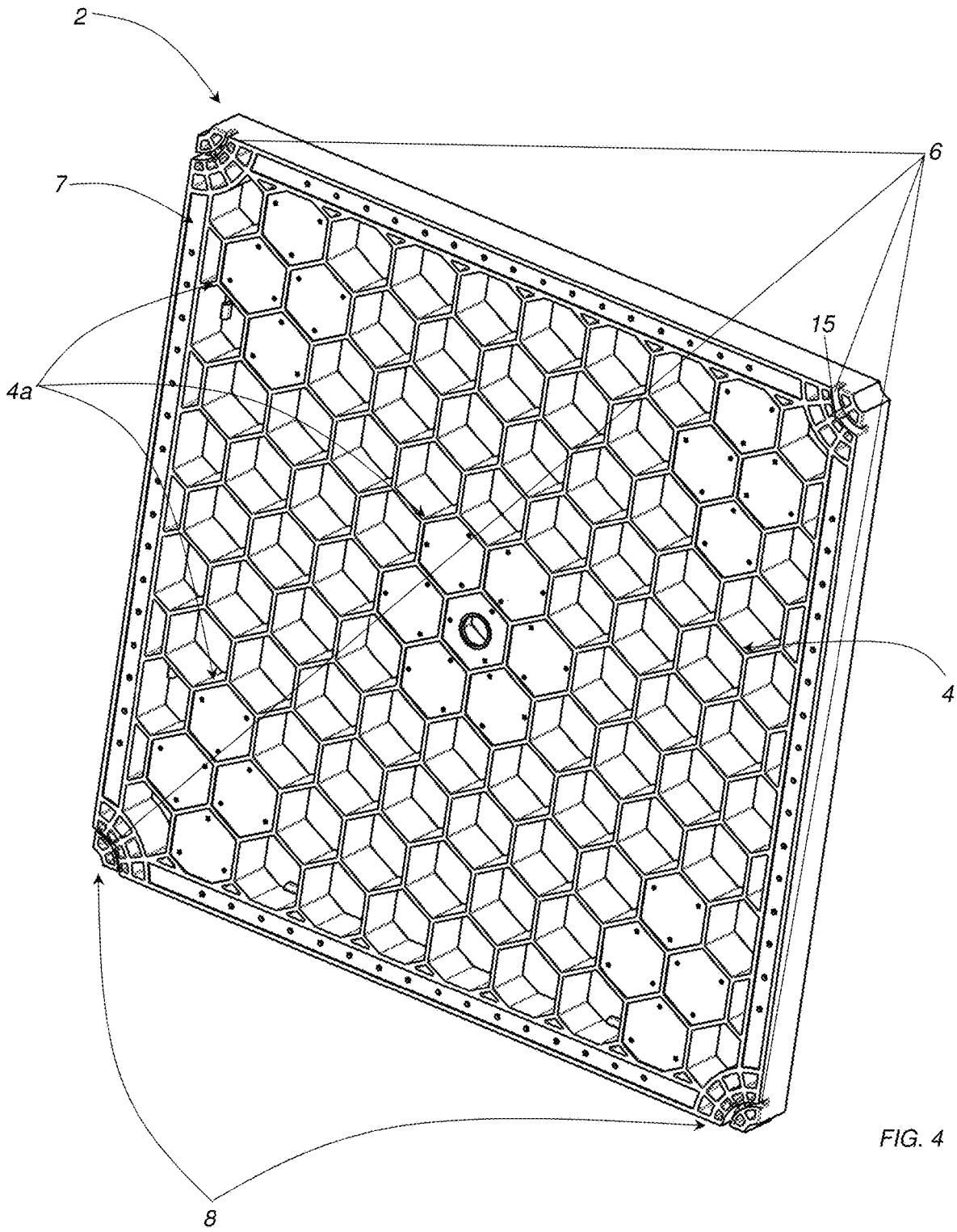
Figure 5:
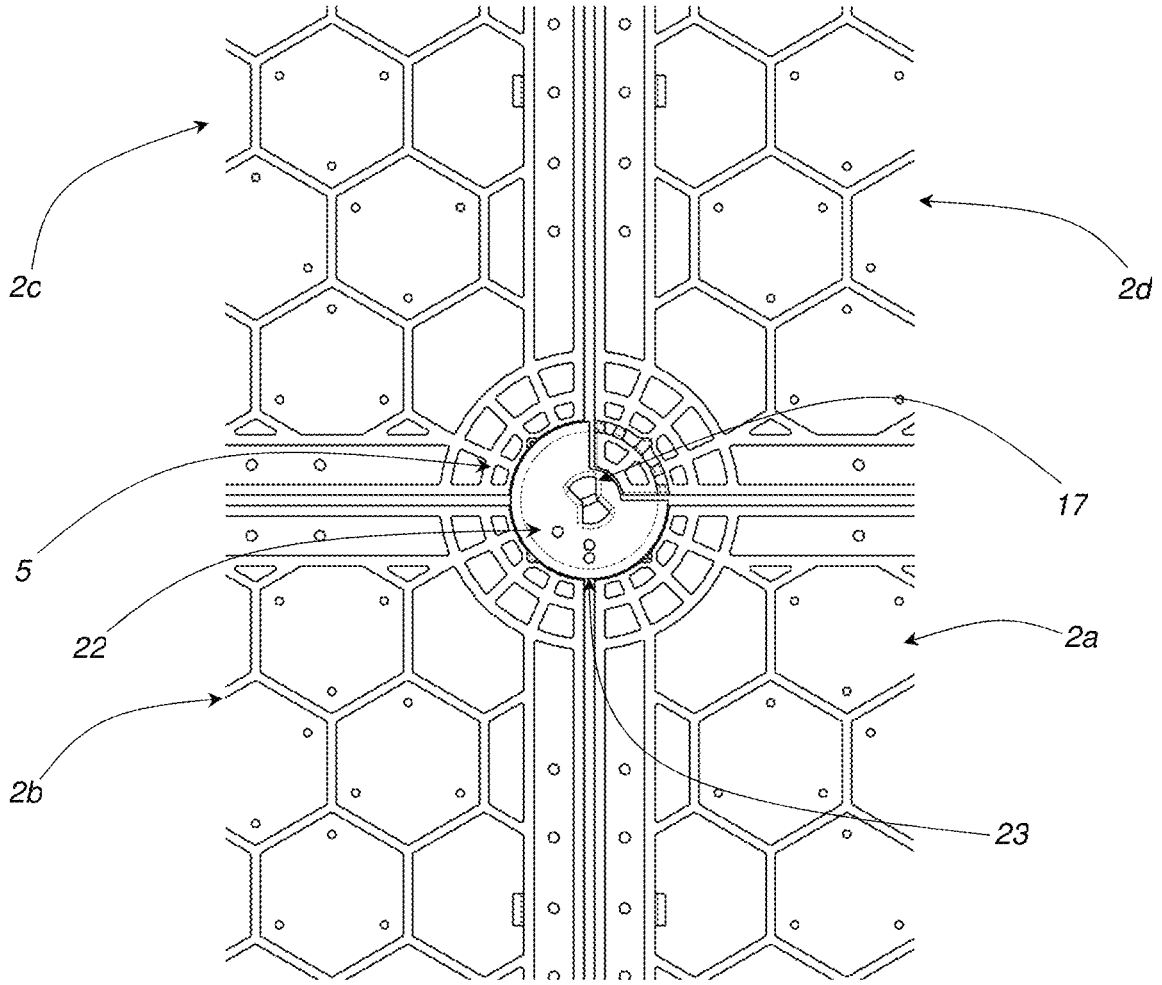

In detail of the embodiment described, the support plates 2 each comprise four grooves 6 made on four perimeter portions of the plates 2. In particular, as can be observed in FIG. 4, in the embodiment represented herein the grooves 6 are made on the upper wall 7 of the support plates 2 at the corners 8 thereof. This aspect, however, shall not be considered a limiting feature for different embodiments of the invention according to which, for example, the grooves are made on the lower portion of the support plates, i.e. at the median in the thickness of the support plate. Moreover, according to different embodiments of the invention not represented herein, it may involve the side of the support plates instead of the corners. In this case, the mutual coupling concerns only pairs of plates and not groups of four plates.

Returning to the coupling mode of the anchoring washer 5 to the support plates 2, it can be observed that the anchoring washer 5, according to another aspect of the invention, has an edge 10 emerging transversely with respect to a perimeter 11 thereof and to the plane identified by the upper surface of the washer 5 itself.

More in detail, the edge 10 is conformed so as to fit inside the grooves 6 of the contiguous support plates 2.

Advantageously, the presence of the edge 10 of the anchoring washer 5 and the respective grooves 6 made on the support plates 2 allow to keep the plates 2 joined together.

Still advantageously, this allows to make the raised flooring more resistant to the wind without having to provide for screwing the support plates to the underlying support structure.

In fact, once the cover tiles 3 are coupled to the support plates 2, the raised flooring will be a single block and, as such, resistant to wind and atmospheric phenomena of greater intensity simply because it becomes heavier and more extensive than the single tile coupled to the support structure as happens in raised floorings of the prior art.

From the above, it is therefore evident that, with the flooring installed, the anchoring washer 5 is hidden as it is located between the support plates 2 and the cover tiles 3. This is particularly advantageous as it allows to obtain a raised flooring resistant to the wind and with a perfectly flat walkable upper surface.

As a result, advantageously, the above makes it possible to create aesthetically pleasing outdoor floorings as well as floorings made in environments protected from atmospheric events.

Moreover, the above allows, still advantageously, to easily keep the raised flooring clean even if it is installed outdoors.

Figure 2:
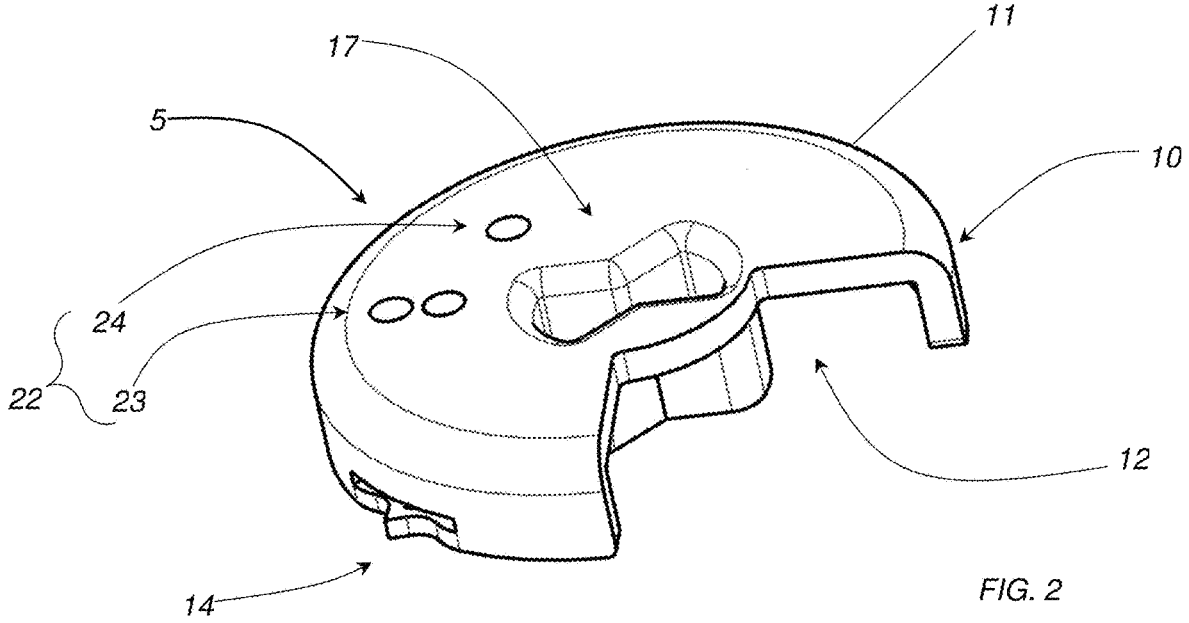
FIGS. 2 to 5 represent details of the windproof and anti-fragmentation device of FIG. 1.
Figure 3:
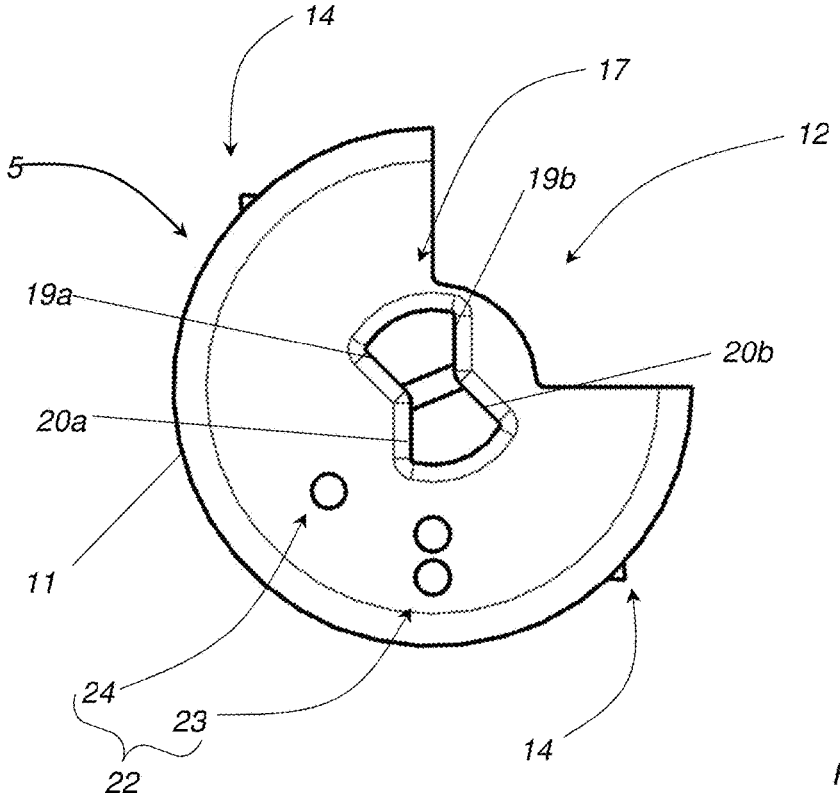

According to another aspect of the invention, the anchoring washer 5 comprises a material gap 12 consisting of a portion of a circular sector of the washer 5. In more detail, as can be observed in the details of FIGS. 2 and 3, in the embodiment represented herein the circular sector portion affected by the material gap 12 comprises a 90° angle, i.e. the width of the corner 8 of the support plates 2 which, as anticipated, have a substantially square shape.

As will be seen below, the presence of the material gap 12 as wide as the corner of the support plates 2 advantageously allows an insertion in place and a disengagement of one of the plates 2 even when the flooring is already installed.

The above advantageously makes the raised flooring versatile as well as easily installable and uninstallable, even partially, if necessary.

As a result, still advantageously, the above allows a rapid installation and uninstallation of the raised flooring with consequent advantageous cost saving.

However, the width of the circular sector portion shall not be considered a limiting feature for different embodiments of the invention. In fact, in the aforementioned embodiment variant in which the grooves are made at the side of the support plate, it is evident that the material gap must involve a circular sector of the anchoring washer having an angle equal to at least 180° in order to be able to extract the adjacent plate. In general, therefore, the material gap must have a width at least equal to the shaping of the support plate involved.

According to another aspect of the invention, the edge 10 comprises two radial projections 14 adapted to fit each into a respective recess 15 made on the perimeter portion of the plates 2.

Advantageously, the presence of the radial projections 14 and of the respective recesses 15 makes it possible to prevent an involuntary rotation of the anchoring washer 5.

It still advantageously follows that the above allows to keep the raised flooring unchanged even following the continuous stresses to which it is subjected by its nature.

Moreover, still advantageously, the above makes it possible to prevent the cover tiles 3 from unintentionally exiting from their position.

As a result, advantageously, this allows to keep the raised flooring aesthetically pleasing over time.

Obviously, the presence of the projections 14 and of the respective recesses 15 shall not be considered a limiting feature for different embodiments of the invention according to which, for example, the projections and the recesses are not present or the anchoring washer is locked by means of a different system.

According to a further aspect of the invention, the anchoring washer 5 comprises a shaped opening 17 so as to allow the insertion of a tool 18 for rotating the anchoring washer 5. In particular, in the embodiment represented herein, the opening 17 consists of a blind hole having a particular shaping aimed at ensuring the housing of the tool 18 in order to rotate the anchoring washer 5. This aspect, however, shall not be considered a limiting feature for different embodiments of the invention according to which, by way of example and not limited thereto, the opening consists of a through hole.

According to another aspect of the invention, moreover, the opening 17 comprises a first pair of abutment walls 19*a* and 19*b* and a second pair of abutment walls 20*a* and 20*b* for the tool 18. In detail, the abutment walls 19*a* and 19*b* and 20*a* and 20*b* of each pair are spaced apart from each other by a predetermined angle which, in particular, according to another aspect of the invention, comprises a 45° angle.

Advantageously, this allows the tool 18 to force a rotation of the anchoring washer 5 over a rotation angle corresponding to the predetermined angle and allow to the tool 18 a subsequent counter-rotation corresponding to the predetermined angle so as to be able to extract it from the opening 17.

As can be seen from the figures, in the particular embodiment described herein, the 45° angle allows the forced rotation to be constrained until the material gap 12 matches the corner 8 of the plate 2 and therefore allows the insertion and disengagement of the same in place, leaving the disengagement of the tool 18 in any case possible. The same applies to the counter-rotation which, therefore, is constrained in such a way as to make the material gap 12 coincide with two plates 2.

However, the width of the predetermined angle shall not be considered a limiting feature for different embodiments of the invention according to which it has a width greater or less than 45° in accordance with the execution of support plates and with the arrangement of the overlapping tiles.

According to another aspect of the invention, the anchoring washer 5 comprises two position indicators 22. In particular, as can be observed in FIGS. 2 and 3, they comprise a first indicator 23 having two small through holes of circular shape and a second indicator 24 comprising a small through hole also of circular shape.

Advantageously, the presence of the position indicators 22 allows the operator who is installing the raised flooring to easily see in the joint between two contiguous 3 tiles whether the anchoring washer 5 is in a coupling position of the support plates 2, i.e. in a release position. In fact, in the embodiment represented herein, if in the joint between two tiles 3 the first indicator 23 is visible, it means that the anchoring washer 5 is in a release position. This means that the plate 2 at whose corner 8 the material gap 12 is located can be raised as it is not constrained to the other plates 2 by the anchoring washer 5.

Conversely, if the second indicator 24 is visible in the joint between two tiles 3, it means that the anchoring washer 5 is in a coupling position. The above means that the material gap 12 of the washer 5 is located between two plates 2 and therefore none of them can be raised.

Obviously, what has been said so far shall not be considered a limiting feature for different forms of embodiment according to which the anchoring washer does not comprise position indicators, i.e. the same are made differently.

Operationally, in order to install the raised flooring with the windproof and anti-fragmentation device 1 according to the invention, the operator, firstly, arranges a first support plate 2*a* in an operating position, i.e., although not depicted in the figures, above the support structure.

The operator then couples the anchoring washer 5 to the first plate 2*a*. In this sense, the operator inserts the edge 10 into the groove 6 of the first plate 2*a*. The operator, then, rotates the anchoring washer 5 until the material gap 12 is at the perimeter portion, that is, in detail of the embodiment represented herein, at the corner 8 of a second support plate 2*b*. In this way the user can arrange the second support plate 2*b* in the operating position by inserting the respective corner 8 in the material gap 12 of the washer 5 and keeping the second plate 2*b* side by side with the first plate 2*a*. Subsequently, the operator still rotates the washer 5 inside the groove 6 of the first plate 2*a* and of the second plate 2*b* until the material gap 12 is at the perimeter portion, that is, similarly to what has been done with the second plate 2*b*, the corner 8 of a third support plate 2*c*. The operator then arranges the third plate 2*c* in the operating position by inserting the respective corner 8 into the material gap 12 of the washer 5 and rotates the latter again until the material gap 12 is at the corner 8 of a fourth support plate 2*d*. As with the previous plates 2, the operator now arranges the fourth plate 2*d* in the operating position by inserting the respective corner 8 into the material gap 12 of the washer 5. Finally, the operator rotates the washer 5 in such a way that the material gap 12 is arranged at two plates 2 and that each radial projection 14 fits into the respective recess 15. In this way the washer 5 remains in place and its involuntary rotations are advantageously avoided.

From the above, it is evident that a windproof and anti-fragmentation device 1 according to the invention advantageously makes the installation of the raised flooring particularly quick and fast.

Still advantageously, the above allows a saving of time in the installation of the raised flooring compared to what happens in the prior art.

As a result, the windproof and anti-fragmentation device 1 according to the invention also allows cost saving to the end user.

Obviously, once the windproof and anti-fragmentation device 1 has been installed, the operator couples the tiles 3 to the support plates 2 by gluing. In more detail, the operator distributes the adhesive on the gluing areas 27, places thereon the tiles 3 and leaves them lie the time necessary for the adhesive to dry.

Thanks to the material gap 12 on the washer 5, if there is a need to raise a tile 3 to carry out various types of work under the flooring, the operator proceeds as follows. He inserts the tool 18 inside the joint that is naturally created between the tiles 3, at the four corners 8 of the same so as to reach the opening 17 made on the washer 5. Then he rotates the washer 5 until the material gap 12 coincides with the corner 8 of the tile to be raised. In particular, the release position of the washer 5 is indicated by the first indicators 23 which are visible in the joint between two tiles 3. At this point the first of the four corners of the plate 2 is free. As a result, the operator will proceed in this way for all the remaining three corners 8 of the plate 2 to be raised in order to free them all and be able to then raise it.

Conversely, once the necessary work has been carried out, the operator will proceed with the repositioning of the plate 2 with the tile 3 superimposed and the subsequent fixing of the corners 8 in order to anchor the plate 2 and therewith the tile 3 to the rest of the raised flooring.

Obviously, what has been said so far regarding the need to carry out work under the raised flooring applies both in the case of raised flooring already installed with the cover tiles 3, and in the case of the presence of only the support plates 2 not yet equipped with a cover.

In light of the foregoing, it is therefore understood that a windproof and anti-fragmentation device according to the invention achieves all the set purposes.

In particular, it makes it possible to create a raised flooring that is resistant to the wind and, more generally, to atmospheric phenomena of particular intensity.

In fact, a windproof and anti-fragmentation device according to the invention allows keeping adjacent tiles joined together, implicitly increasing the resistance of the flooring to the wind.

Furthermore, the windproof and anti-fragmentation device allows a simple and quick installation of the raised flooring.

Moreover, it allows for easy disassembly of the flooring.

It follows that a windproof and anti-fragmentation device according to the invention allows a saving of time in the installation of the flooring and, consequently, a cost saving for the end user.

Moreover, a windproof and anti-fragmentation device according to the invention allows to obtain a raised flooring resistant to the heaviest loads.

As a result, it prevents one or more tiles from cracking or even fragmenting, causing danger to people.

It follows that a windproof and anti-fragmentation device according to the invention makes it possible to avoid replacing damaged tiles.

The invention is susceptible to numerous modifications and variations, all falling within the appended claims. All the details may be replaced by other technically equivalent elements, and the materials may be different depending on the needs, without departing from the scope of protection of the invention defined by the appended claims.

The invention claimed is:

1. A windproof and anti-fragmentation device of a raised flooring comprising:

a plurality of support plates for one or more cover tiles, said support plates being arranged side by side, said support plates each comprising a groove defined on a perimeter portion of said plates; and an anchoring washer couplable to one or more of said support plates and having an edge emerging transversely with respect to a perimeter of said anchoring washer, said edge being configured to fit at least partially inside said groove of at least two of said support plates disposed contiguously so as to keep said at least two support plates joined together, wherein said anchoring washer comprises a shaped opening configured to allow an insertion of a tool used to rotate said anchoring washer, said shaped opening having an hourglass-shaped perimeter defined by adjoined opposing trapezoids with rounded bottoms and with lateral walls that provide abutment surfaces for said tool, said abutment surfaces being spaced apart from each other by a predetermined angle so as to allow said tool to force a rotation of said anchoring washer over a rotation angle corresponding to said predetermined angle and further allow a counter-rotation of said tool corresponding to said predetermined angle while avoiding a counter-rotation of said anchoring washer, whereby said tool can be extracted from said opening.

2. The windproof and anti-fragmentation device according to claim 1, wherein said anchoring washer comprises a material gap shaped as at least a portion of a circular sector of said anchoring washer so as to allow an insertion in place and a disengagement of at least one of said support plates.

3. The windproof and anti-fragmentation device according to claim 1, wherein said edge comprises a radial projection configured to fit into a respective recess made on said perimeter portion of said plates so as to prevent an involuntary rotation of said anchoring washer.

4. The windproof and anti-fragmentation device according to claim 1, wherein said predetermined angle is a 45° angle.

5. The windproof and anti-fragmentation device according claim 1, wherein said support plates comprise a grid.

6. The windproof and anti-fragmentation device according to claim 1, wherein said support plates comprise one or more areas for gluing said one or more cover tiles thereto.

7. The windproof and anti-fragmentation device according to claim 1, wherein said at least one anchoring washer comprises position indicators.

* * * * *